US006786019B2

(12) United States Patent
Thiers

(10) Patent No.: US 6,786,019 B2
(45) Date of Patent: Sep. 7, 2004

(54) FLOOR COVERING

(75) Inventor: Bernard Paul Joseph Thiers, Oostrozebeke (BE)

(73) Assignee: Flooring Industries, Ltd., Dublin (IE)

( * ) Notice: Subject to any disclaimer, the term of this patent is extended or adjusted under 35 U.S.C. 154(b) by 0 days.

(21) Appl. No.: 09/805,234

(22) Filed: Mar. 14, 2001

(65) Prior Publication Data

US 2002/0056245 A1 May 16, 2002

(30) Foreign Application Priority Data

Jun. 13, 2000 (BE) ..... 2000/0381

(51) Int. Cl.[7] ..... E04B 2/08; E04B 2/00

(52) U.S. Cl. ..... 52/589.1; 52/586.1; 52/590.2; 52/592.1

(58) Field of Search ..... 52/578, 589.1, 52/592.1, 570, 571, 572, 590.2, 586.1, 592.3, 591.1, 590.1

(56) References Cited

U.S. PATENT DOCUMENTS

| | | | | |
|---|---|---|---|---|
| 444,042 | A | * | 1/1891 | Brock |
| 1,551,544 | A | * | 9/1925 | Crooks |
| 2,226,540 | A | * | 12/1940 | Boettcher |
| 2,328,051 | A | * | 8/1943 | Bull |
| 3,204,380 | A | * | 9/1965 | Smith |
| 3,720,027 | A | * | 3/1973 | Christensen |
| 4,953,335 | A | | 9/1990 | Kawaguchi et al. |
| 5,381,638 | A | * | 1/1995 | Andersson |
| 5,502,939 | A | * | 4/1996 | Zadok |

(List continued on next page.)

FOREIGN PATENT DOCUMENTS

| | | | | |
|---|---|---|---|---|
| AT | 005 566 U1 | | 8/2002 | |
| DE | 202 06 460 U1 | * | 8/2002 | ..... E04F/15/04 |
| EP | 07180333 | | 7/1995 | |
| ES | 1 019 585 | | 4/1992 | |
| ES | 2 168 045 | | 5/2002 | |
| FR | 2 623 544 | | 5/1989 | |
| GB | 2 256 023 | | 11/1992 | |
| GB | 2 256 023 A | | 11/1992 | |
| JP | 06320510 | | 11/1994 | |
| JP | 07076923 | | 3/1995 | |
| JP | 8-109734 | | 4/1996 | |

OTHER PUBLICATIONS

Fantoni Plaxil: MDF Medium Density Fiberboard. Literature describing production, processing, applications; pp. 41–43, 49, 50, 93. European Association of MDF Producers. Undated.

(List continued on next page.)

*Primary Examiner*—Carl D. Friedman
*Assistant Examiner*—Kevin McDermott
(74) *Attorney, Agent, or Firm*—Becon & Thomas, PLLC

(57) ABSTRACT

Floor covering hard panels having at least on two opposite edges, coupling elements made in one piece with the panels, so that several ones of such panels can be mutually coupled, whereby these coupling elements provide for an interlocking in a direction perpendicular to the plane of the panels, as well as in a direction perpendicular to the edges and parallel to the plane of the panels, and whereby these coupling elements are made such that the panels can be rotated into and/or out of one another at least along the above-mentioned edges. The panels are provided, at least on the above-mentioned edges, near the top side, with a part from which has been removed an amount of material such as by a bevel.

18 Claims, 4 Drawing Sheets

U.S. PATENT DOCUMENTS

| | | | | | |
|---|---|---|---|---|---|
| 5,570,554 | A | | 11/1996 | Searer | |
| 5,618,602 | A | * | 4/1997 | Nelson | |
| 5,744,220 | A | | 4/1998 | Ringo | |
| 5,755,068 | A | * | 5/1998 | Ormiston | |
| 5,797,237 | A | * | 8/1998 | Finkell | |
| 5,834,081 | A | * | 11/1998 | Fanti | 428/44 |
| 6,006,486 | A | * | 12/1999 | Moriau | |
| 6,131,355 | A | | 10/2000 | Groh et al. | |
| 6,324,803 | B1 | * | 12/2001 | Pervan | |
| 6,324,809 | B1 | * | 12/2001 | Nelson | |
| 6,332,733 | B1 | * | 12/2001 | Hamberger | |
| 6,363,677 | B1 | | 4/2002 | Chen et al. | |
| 6,401,415 | B1 | | 6/2002 | Garcia | |
| 6,581,351 | B2 | | 6/2003 | DeVivi | |
| 6,617,009 | B1 | * | 9/2003 | Chen et al. | 428/148 |
| 6,675,545 | B2 | * | 1/2004 | Chen et al. | 52/586.1 |
| 2002/0110669 | A1 | | 8/2002 | Garcia | |

OTHER PUBLICATIONS

Technical Information—MDF Medium Density Fiberboard. "Laminating Techniques for MDF (2)." Euro MDF Board. 1990.

A User's manual concerned with the manufacture, availability and processing of medium density fibreboard for the furniture, fitments and building industries. Euro MDF Board. Jan. 1993, pp. 67–69, 85, 88, and 89.

Arbeitskreis MDF. Brochure of Kurz GmbH & Co., Furth, Germany. (1988), pp. 116–120.

* cited by examiner

FLOOR COVERING

BACKGROUND OF THE INVENTION

1. Field of the Invention

The present invention concerns floor covering panels, in particular hard laminate panels.

2. Related Art

It is known that such laminate panels can be made of different layers. Usually, the panels are formed of boards based on wood products, such as chipboard or fibreboard, in particular MDF or HDF (medium density fiberboard and high density fiberboard), upon which one or several layers, including a panel decorative layer, are provided at least on the top side. The panel decorative layer may be a printed paper layer, but in certain embodiments it may just as well be a layer of wood, in particular veneer. Such panels can also be made of other materials, for example merely synthetic material, or of a base plate having a wood base, such as chipboard, MDF or HDF and the like, upon which is provided, instead of a printed paper layer or veneer, another material such as cork, thin strips of wood and the like.

It is also known to couple these panels on their edges as they are laid, either by means of a conventional tongue and groove joint, whereby they are possibly glued together, either by means of a glueless coupling which provides for a mutual interlocking of the panels both in the horizontal and vertical direction, for example as described in international patent Publication No. WO 97/47934.

SUMMARY OF THE DISCLOSURE

The present invention relates to hard laminate panels for forming a floor covering and which provides for new embodiments according to different aspects offering respective-advantages.

According to a first aspect, the invention provides for a floor panel comprising at least on two opposite edges having coupling means or elements made in one piece with the panels, so that several ones of such panels can be mutually coupled at such edges, whereby these coupling elements provide for an interlocking in a direction perpendicular to the plane of the floor covering, as well as in a direction perpendicular to the edges concerned and parallel to the plane of the floor covering, and whereby these coupling elements are made such that the panels can be rotated into and/or out of one another at least along the above-mentioned edges, and wherein the panels are provided, at least on the above-mentioned edges, near the top side, with a part from which has been removed an amount of material (e.g., a bevel).

With material removed from the top edge, several advantages are obtained. A first advantage consists in that the panels, as they are rotated, both when rotating into one another and when rotating out of one another, can be moved more easily in relation to one another, as there are no angular edges anymore which hinder the mutual rotation of the panels. A second advantage consists in that the panels can be made heavier, in particular thicker than as usual, as the thickness of the panels, thanks to the bevel, has little or no influence anymore on the good working order of the above-mentioned coupling means, during the rotating in and/or the rotating out.

Preferably, the above-mentioned parts consist of bevels, in particular with a gradient of 45°. Practically, the bevels preferably extend, in a horizontal direction, over a distance of at least 1 millimeter. Preferably, however, this distance is in the order of magnitude of 2 millimeter.

According to a different variant of the first aspect of the invention, the coupling elements are made such that the panels, instead of being disconnectable at least by a rotation, can be disconnected from one another at least in one other manner. Even then, the above-mentioned bevel still offers certain advantages, as will become clear from the following description.

According to the most preferred embodiment, the panels are rectangular and are provided with the above-mentioned parts, that is, the above-mentioned bevels, respectively, on all four-sides.

According to a second aspect which can either or not be combined with the first aspect, the invention provides for a floor covering panel comprising a hard panel with a core upon which is provided a panel decorative layer, whereby these panels are rectangular and elongated and are provided with coupling means at least on the two opposite longitudinal edges, so that several ones of such panel can be mutually coupled to one another, whereby these coupling elements provide for an interlocking in a direction perpendicular to the plane of the floor covering, as well as in a direction perpendicular to the edges concerned and parallel to the plane of the floor covering, and whereby these coupling elements are made such that each panel can be coupled to and/or uncoupled from another similar panel by means of a rotation along their opposed longitudinal edges, and the width of the panels is smaller than 17 cm, and preferably even smaller than 16 cm.

Further, the panel, apart from the above-mentioned maximum width, preferably has a length which amounts to at least eight times the width.

It is known that hard panels, which are equipped with coupling elements which provide for a horizontal and a vertical interlocking on at least two of their edges, are made as relatively small plates with a width of 19 to 20 cm and a length of 1.20 to 1.40 m. It is also known that the plates, when being laid, have to be occasionally rotated into one another and out of one another so as to make them fit against a wall, skirting board or the like. A disadvantage of the known embodiments of the above-mentioned plates consists in that it is often difficult to carry out said rotation, for example when the plates have to be installed with their far ends under the edge of an overhanging cupboard or such. According to the above-mentioned second aspect of the invention, this disadvantage, as well as others, are avoided, if not minimised. Thanks to the small width, the panels are less high when being rotated, so that there are no disadvantages during the installation in a large number of practical applications.

Moreover, the above-mentioned relation between length and width offers a technical solution, as a result of which the visual 'plate-like' effect is excluded.

According to a third aspect of the invention, floor covering panels having a laminated structure include a panel decorative layer on the top surface, and bevels or such are formed as by cutting away on one or several edges of the panels, near the top side and the surface of these bevels is also provided with a bevel film or coating-like decorative layer, preferably a layer provided as a separate material and separate from the panel decorative layer. In particular, such a layer preferably consists of a separately provided print. Thanks to the use of such a separate print, the bevels can be easily provided with a bevel decorative surface. The base panels can then be made in a conventional manner by sawing them out of a large plate which has already been provided with a panel decorative layer, and the bevels may be printed later.

According to a major embodiment of the third aspect, the above-mentioned print consists of a print which is obtained by means of transfer printing. Such transfer printing offers the advantage, in combination with its use on floor panels, that high production rates can be obtained and that any pattern whatsoever can be realized. Further, this technique excludes the risk of the decorative top surface of the panels being soiled. Another major advantage hereby consists in that the print is immediately or almost immediately dry, so that the panels can be stacked and packed almost immediately.

Preferably, the floor panels, which are made according to the third aspect of the invention, have a core made of a material having a wood base, in particular wood which has been ground into particles or fibres, mixed with a binding agent, upon which the decorative layer is provided, and whereby the above-mentioned bevels extend through the material of the core. Thus a porous surface is obtained on the bevels, guaranteeing a good bond for the print layer.

As usual, the decorative layer of the panel preferably contains a layer printed with a pattern, such as a wood pattern, and the decorative layer according to the invention, in particular the print on the bevels or such, is preferably a similar pattern.

Moreover, use is preferably made of a moisture-proof, impermeable bevel decorative layer or print respectively, which is particularly advantageous in case the panels have a base plate which consists of porous material, such as MDF, HDF (medium density fiberboard and high density fiberboard) or the like. Thus is obtained an entirely moisture-proof structure on the top surface, on the flat surface by means of the usual layer of synthetic material on the one hand, and on the bevels by means of the additional bevel decorative layer situated on the bevel on the other hand.

Although the decorative layer on the bevels is preferably realized by means of transfer printing, other possibilities are not excluded. Thus, for example, use can be made of a self-adhesive strip.

According to a fourth aspect, the invention provides for a floor covering panel having a core made of MDF or HDF, or a similar material, wherein the panel is provided with an underlayer provided on the bottom side and fixed onto it, preferably made of polyethylene or a polyethylene based material. The combination of MDF or HDF with the use of an underlayer fixed onto it, especially when it is formed of polyethylene or is made on the basis of polyethylene, offers the advantage that particularly good sound-insulating qualities are obtained.

The present invention concerns embodiments applying only one of the above-mentioned aspects as well as embodiments in which two or several of the above-mentioned aspects are combined. In this respect it should be noted that two or several of the above-mentioned embodiments can be mutually combined at random, in any possible combination, provided these embodiments have no contradictory qualities.

Although, according to some of the above-mentioned aspects, the panels may consist of different sorts of material, the invention is particularly suitable for panels made of MDF or HDF, or a similar material.

According to a special embodiment, the panels have a thickness of 9 mm at the least, and better still of 10 mm at the least, as opposed to the usual thickness of 7 or 8 mm.

Thus are obtained relatively heavy panels, which consequently have a better sound-insulating effect, as a result of which less sound is produced when they are walked on.

In so far as coupling means as mentioned above are used which allow for a glueless interlocking, they can be of different nature. Thus, these coupling means can have one of the following characteristics or a combination of two or several of them:

- that they are provided on two opposite edges of the panels;
- that they are provided on panels which are rectangular, whereby they are provided on both pairs of opposite edges;
- that at least for a number of the edges they allow for an assembly according to one of the following possibilities:
  - at-least by shifting the panels towards one another;
  - exclusively by shifting the panels towards one another;
  - at least by rotating the panels along the edges concerned;
  - exclusively by rotating the panels along the edges concerned;
  - by shifting the panels towards one another or by rotating them, as desired;
- that, at least for a number of the edges, they allow for an uncoupling according to any of the following possibilities:
  - at least by shifting the panels but of one another in a direction perpendicular to the edges;
  - exclusively by shifting the panels out of one another in a direction perpendicular to the edges;
  - at least by rotating the panels along the edges concerned;
  - exclusively by rotating the panels along the edges concerned;
  - by shifting the panels out of one another as well as by rotating them;
- that they are of the type which consists of a tongue and a groove on the one hand, and of locking means which ensure at least a specific interlocking in a direction perpendicular to the edges of the coupled panels and parallel to the plane of the panels on the other hand;
- that they are realized as in the preceding paragraph, whereby the lip which limits the bottom side of the groove, seen from a cross section, extends past the upper lip, and whereby the locking means consist of one or several parts on the lip limiting the bottom side of the groove on the one hand, and of one or several parts on the bottom side of the tongue working in conjunction with the latter on the other hand;
- that the above-mentioned tongue and groove are made such that when two of such panels are freely shifted towards one another, over a base or such, the tongue automatically is introduced into the groove;
- that they are formed such that the panels, when coupled, fit into one another without any play or almost without any play.

Naturally, the invention also concerns panels with which the above-described floor coverings can be realized.

BRIEF DESCRIPTION OF THE DRAWINGS

In order to better explain the characteristics of the invention, the following preferred embodiments are described as an example only without being limitative in any way, with reference to the accompanying drawings, in which.

DETAILED DESCRIPTION OF PREFERRED EMBODIMENTS OF THE INVENTION

Figure 1:
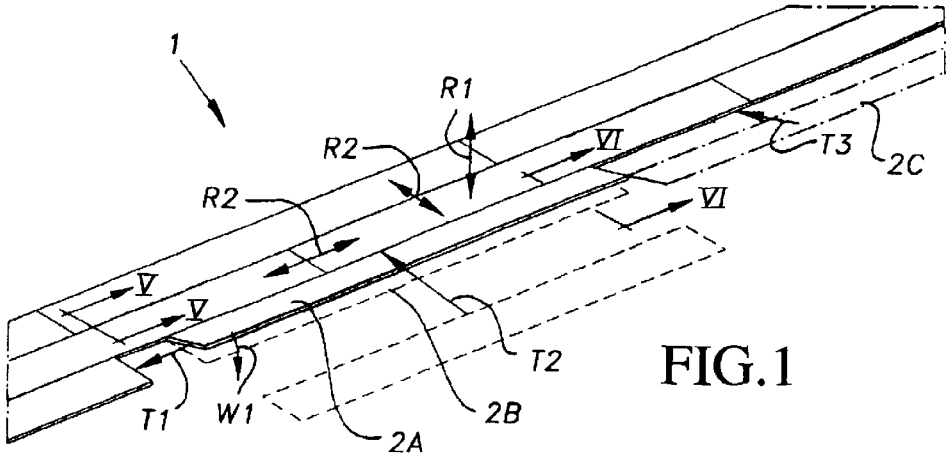
FIG. 1 schematically represents a part of a floor covering which is built up of panels according to the invention.
Figure 2:
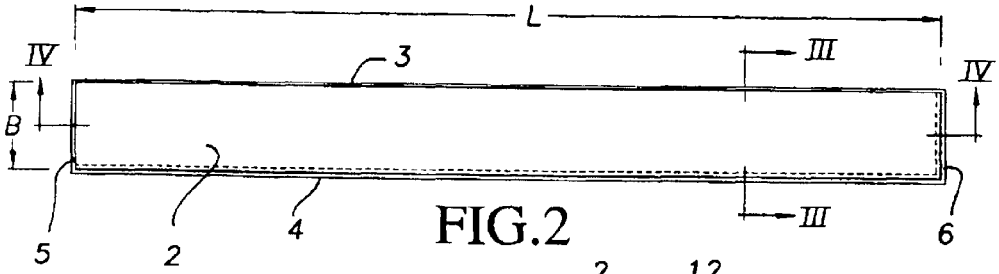
FIG. 2 represents a top view of a panel from the floor covering of FIG. 1.

As represented in FIGS. 1 and 2, the invention concerns a floor covering 1 as well as hard panels 2 from which such a floor covering 1 is built up.

According to a first aspect of the invention, a floor covering 1 is formed of hard laminate panels 2, wherein these panels 2 are provided at least on two opposite edges 3–4, and preferably, as represented in the FIGS. 2 to 8, on both pairs of edges 3–4, 5–6 respectively, with coupling means or elements 7 made in one piece out of the core material of the panels 2, so that several of such panels 2 can be mutually coupled to one another, whereby these coupling means 7 provide for an interlocking in a direction R1 perpendicular to the plane of the floor covering 1, as well as in, a direction R2 perpendicular to the edges 3–4 or 5–6 concerned and parallel to the plane of the floor covering 1 or panels 2, and whereby these coupling means 7 are made such that the panels 2 can be assembled and/or disassembled at least along the above-mentioned edges 3–4, 5–6 respectively, by means of a rotation.

Such coupling means 7, which make it possible to couple the panels 2 without any glue being required, at least on two sides and preferably on all sides, and whereby the panels 2 are uncoupled by rotating them out of one another, are known as such from international patent Publication No. WO 97/47834.

From WO 97/47834 it is also known that the above-mentioned coupling means 7, as represented in FIGS. 3 to 8 of the present application, may consist of a tongue 8 and a groove 9 on the one hand, and of locking device 10 on the other hand which at least ensure a specific interlocking in a direction perpendicular to the edges 3–4, 5–6 respectively, of the coupled panels 2 and parallel to the plane of these panels 2. As is further represented, these coupling means 7 are moreover preferably made such that the lip 11 which limits or defined the bottom side of the groove 9, seen from a cross section, extends past the upper lip 12, while the locking means 10 are formed of interlocking parts 13–14 working in conjunction, on the above-mentioned lip 11 which limits the bottom side of the groove 9 and on the bottom side of the coupled panel 2 respectively, in particular the bottom side of the tongue 8 or the extension of this bottom side.

As explained in WO 97/4834, such coupling means 7, depending on their embodiment, allow for different couplings. According to the most preferred embodiment, they are, as will be described hereafter by means of FIG. 1, made such that they allow for a coupling by rotating into one another as well as by shifting towards one another in a generally common plane. The latter allows such panels to be coupled by first rotating them into one another on their edges 3–4, as represented by the panel 2A in FIG. 1, with a rotation W1, and by subsequently snapping them together on their edges 5–6 by means of a translation T1. According to a variant, the connection on the edges 3–4 of the panels concerned can also be realized by starting from a position as is schematically indicated with reference 2B, and by coupling the panel concerned by means of a translation or sliding motion T2.

Figure 6:
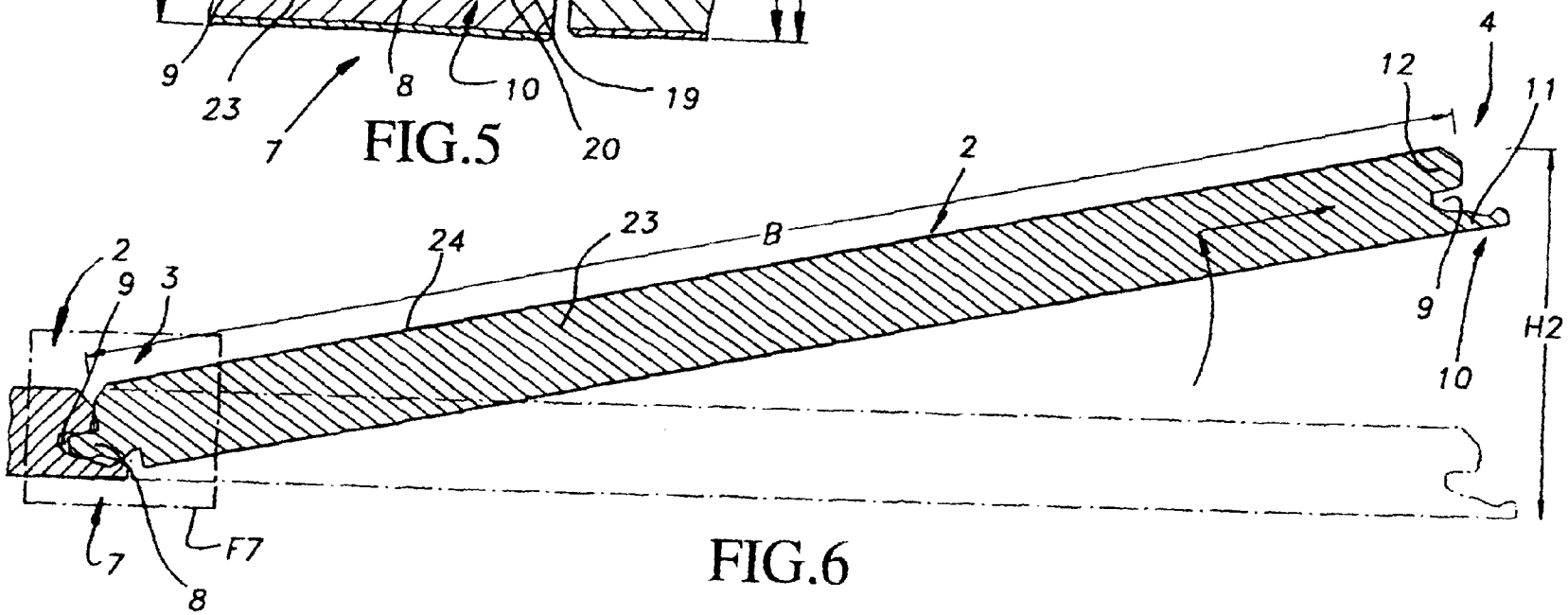
FIG. 6 represents a section according to line VI—VI in FIG. 1 to a larger scale.
Figure 7:
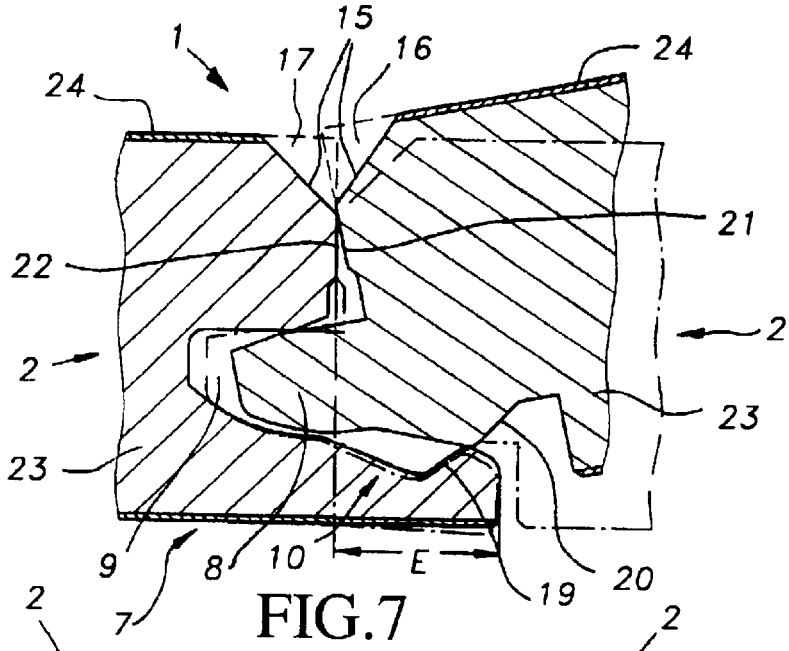
FIG. 7 represents the part indicated by F7 in FIG. 6 to a larger scale.
Figure 8:
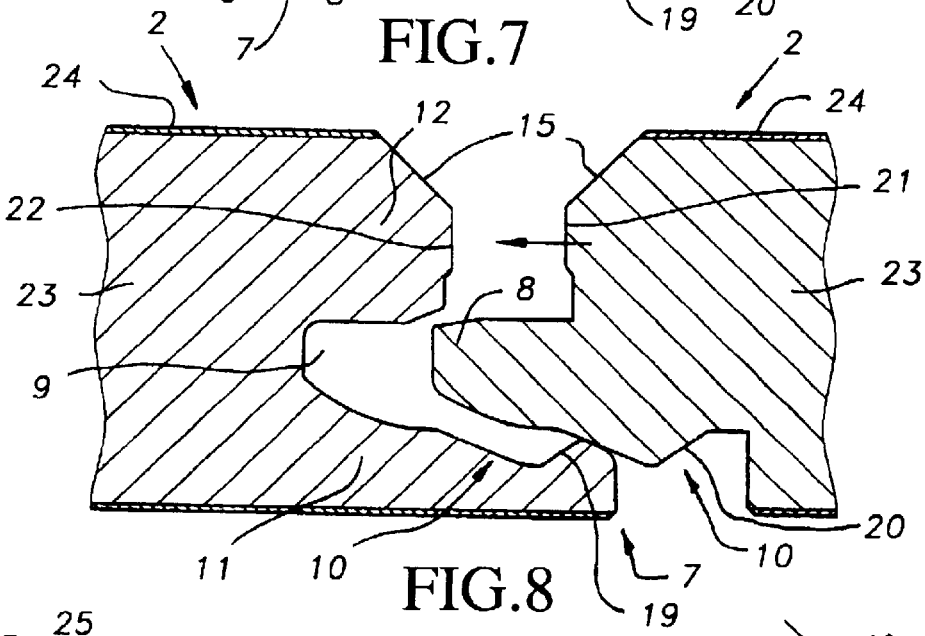
FIG. 8 shows a view analogous to that in FIG. 7, but whereby the panels are mainly shifted towards one another in one and the same plane.

The above-mentioned rotation is further illustrated in FIGS. 6 and 7, whereas the sliding motion is represented in FIG. 8. It should be noted that the tongue 8 and groove 9 are preferably made such that, as is also represented in FIG. 8, when two such panels 2 are freely shifted towards one another over a bottom or support, the tongue 8 automatically is introduced into and ends up in the groove 9.

It is also possible, while holding a panel 2A in a rotated position, to couple a following panel 2C onto it on the edges 5 and 6 respectively, either by means of a generally co-planar translation T3, or by a mutual rotation between the panels 2A and after which both panels 2A and 2C are then rotated down to be interlocked with the preceding row of panels.

Another advantage consists in that a glueless coupling without any play or practically without any play remains possible, also with thicker panels which can be rotated into and/or out of one another, without any extreme compression forces being created on the edge parts during the rotation. The bevels according to this invention ensure that such forces are excluded and/or remain limited, so that the risk of damages, among others to the top layer or to the surface of the bevels, are excluded, if not restricted.

What makes the first aspect of the invention special is that the above-mentioned panels 2 are provided, at least on two of their edges 3–4 or 5–6 and preferably on all four edges 3 to 6, near the top side, with a part from which an amount of material has been cut-away and removed (a cut-away portion), which part preferably each time is in the form of a bevel 15.

As represented in FIGS. 6 and 7, these bevels 15 among others offer the advantage that the panels 2 can be easily rotated in relation to one another, as the material parts 16 and 17 which are otherwise present no longer press onto one another, and a contact zone 18 is obtained which is situated relatively low in the panel thickness.

Figure 5:
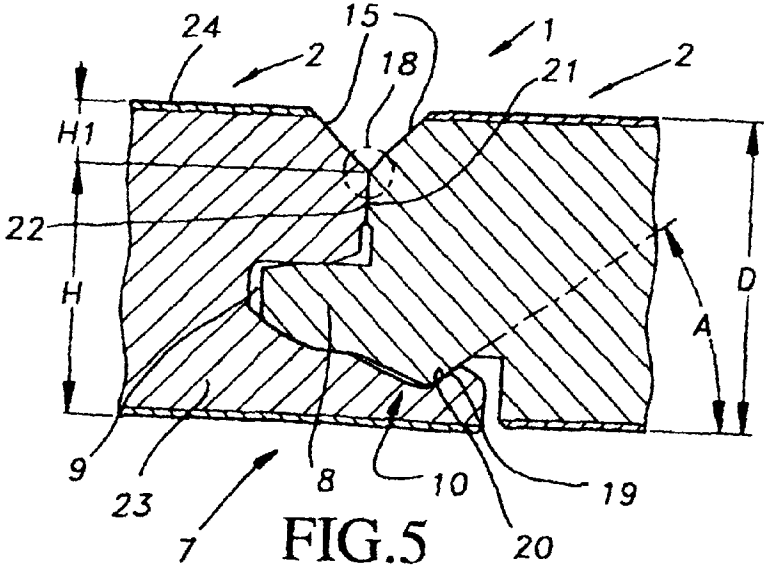
FIG. 5 represents a section according to line V—V in FIG. 1 to a larger scale.

Another advantage is that when it is required for the above-mentioned interlocking parts 13 and 14, in particular the accompanying contact surfaces 19 and 20, to extend tangentially or almost tangentially around a circle having the contact zone 18 as its centre, the average gradient A of the contact surfaces can be kept relatively large for a same distance E of the protruding part of the lower lip 11, as indicated in FIG. 5, as a result of which a solid interlocking can be ensured, even with thicker panels 2.

Another advantage consists in that, irrespective of the thickness D of the panels 2, the contact zone 18 can always be situated at a certain height H above the bottom side of the panels 2, provided the bevels 15 are realized over an appropriate height H1. Thus it is possible, if required, to always work with similar cutting tools to form the tongue 8 and groove 9, for thinner as well as for thicker 5 panels 2.

Although the above-mentioned advantages are particularly felt with embodiments of the type whereby the uncoupling of the panels 2 can be realized by means of a rotation around the above-mentioned contact zone 18, it should be noted that the above-mentioned bevels 15 also offer advantages which do not necessarily coincide with the fact whether it is either or not possible for the panels 2 to be disassembled by means of rotation. Such bevels 15 offer the advantage that the panels 2 never press directly onto one another on their top surface, so that damage of the top layer resulting from mutual contact between the panels 2 is excluded, which is particularly important in the case of laminate parquet, as well as for floor coverings which are connected without any glue and whereby the panels are driven one another laterally in a generally common plane by means of a hammer and a stop block.

Also, according to a different embodiment, the first aspect of the invention no longer merely applies to panels 2 which can be disassembled by means of a rotation, hut it also applies to all sorts of panels 2 which are provided with coupling means 7 which make it possible for the panels 2 to be interlocked both vertically and horizontal on their edges 3–4, 5–6 respectively, irrespective of whether the assembly and/or disassembly has to be or can be realized by means of a rotation or sliding motion.

The above-mentioned bevels 15 preferably extend at an angle X of 45° in relation to the plane which is determined by or includes the panels 2. However, other gradients are not excluded.

Practically, the bevels 15 will extend in a horizontal direction over a distance Z in the order of magnitude of 2 millimeter, although other dimensions are not excluded here either.

As is further represented in FIG. 5, lateral surfaces, in particular contact surfaces 21–22 are present under the above-mentioned bevels 15, which fit up to one another at least at the top when the panels 2 are coupled, and thus form a mutual stop.

It is clear that the first aspect of the invention can be applied with panels 2 having an elongated design, as represented in FIG. 2, as well as with panels 2 having a square design.

According to the above-mentioned second aspect of the invention, which the given example of FIGS. 1 and 2 is combined with the above-mentioned first aspect, but which can also be realized as separate from the first aspect, the invention concerns a floor covering 1, consisting of laminated hard panels 2 having a core 23 and a panel decorative upper surface 24, whereby these panels 2 are rectangular and elongated and are provided with coupling means 7 on at least two opposite longitudinal edges 3–4 and/or 5–6, as a result of which several of such panels 2 can be mutually coupled to one another, whereby these coupling means 7 are provided with an interlocking in a direction perpendicular to the plane of the floor covering 1, as well as in a direction perpendicular to the edges 3–4-5–6 concerned and parallel to the plane of the floor covering, and whereby these coupling means 7 are made such that the panels 2 can be coupled and/or uncoupled by means of a rotation along their longitudinal edges 3–4 and/or 5–6, such that the useful width B of the panels 2 is smaller than 17 cm, and preferably amounts to 15.5 cm.

Such a narrow width B, combined with coupling means 7 of the type whereby the uncoupling has to be carried out by rotating the panels 2 in relation to one another, as represented in FIG. 6, offers the advantage that the height H2 over which the panel 2 to be uncoupled has to be rotated before it is detached, also remains relatively small, as a result of which the disadvantage mentioned in the introduction is minimised.

Moreover, the panels 2, according to the second aspect of the invention, preferably also have a length L which amounts to at least eight times the width B.

Preferably, the panels 2 made according to the second aspect of the invention, also have a single pattern which is repeated over the entire top surface, in particular a wood pattern.

Figure 9:
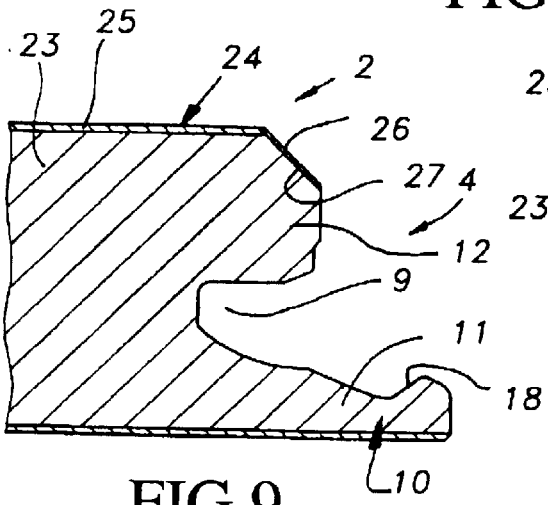
FIG. 9 shows a section of another panel according to the invention, with bevels which are provided with a print.

FIG. 9 illustrates the third aspect of the invention. According to this third aspect, the invention concerns a floor covering 1 consisting of hard panels 2 with a laminated structure, having a panel decorative layer 25 on the top surface, wherein cut-away bevels 15 or such are formed on one or several edges 3 to 6 of the panels 2, near the top side, and in that the exposed surface of these bevels 15 or such is also provided with a bevel decorative layer, in this case a print 26, which is preferably obtained as a print layer that has been provided on this surface by means of transfer printing.

As shown in FIG. 8, the cut-away bevels 15 extend through the core 23 of each panel as well as the panel decorative layers 24, thereby exposing edges of the respective layers 23 and 24. The print layer 26 (FIGS. 9, 10) covers or masks the exposed core and panel decorative edges, preferably matching the pattern of the panel decorative layer so that, when viewed from the top surface, the exposed bevel area is covered by the bevel decorative layer.

The bevel decorative layer 25 may as such consist of several layers, but it preferably contains at least one film or coating-like layer imprinted with a pattern, for example a food pattern printed on a paper layer. In this case, the print 26 can be realized on the bevels 15 or such with a similar pattern. As a printing technique is applied for the decorative layer as well as for the print 26, it is very easy to match both patterns as far as colour and/or design are concerned.

As mentioned in the introduction, the print 26 is preferably moisture-proof and impermeable. Thus is obtained a sealing on the bevels 15, which is particularly useful when the panels have a porous core, for example made of MDF or HDF.

Figure 10:
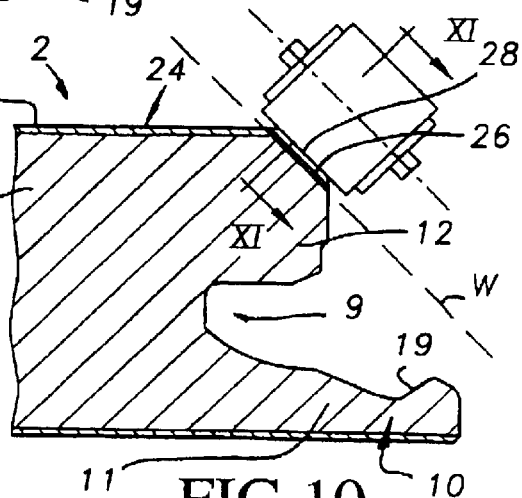
FIG. 10 schematically represents how the print can be provided in the embodiment of FIG. 9.
Figure 11:
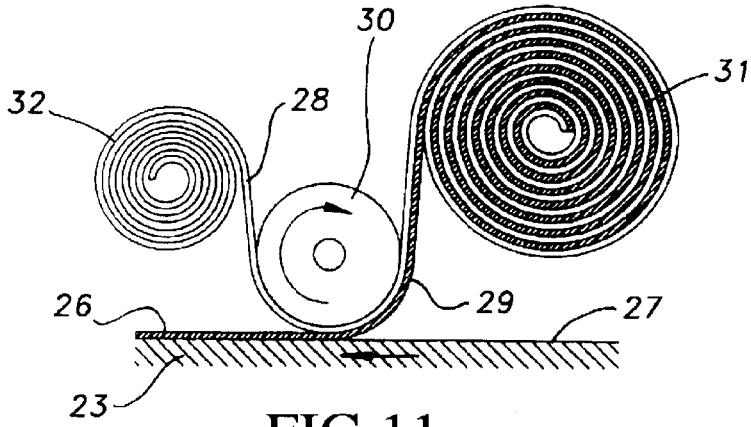
FIG. 11 schematically represents a section according to line XI—XI in FIG. 10.

FIGS. 10 and 11 schematically represent how the print 26 can be provided on the surface 27 by means of transfer printing. A support 28 which is provided with a printing layer 29 is put into contact with the surface 27 and is applied with a preferably heated press-n roller 30, as a result of which the printing layer 29 adheres to the material of the panel 2 and comes off the support 28, so that the above-mentioned print 26 is created. The support 28 with the printing layer 29 is hereby supplied as of a roller 31, whereas said support 28, after the printing layer 29 has been transferred to the surface 27, is rolled up on a roller 32.

Other transfer printing techniques which are known as such are not excluded, however.

Figure 3:
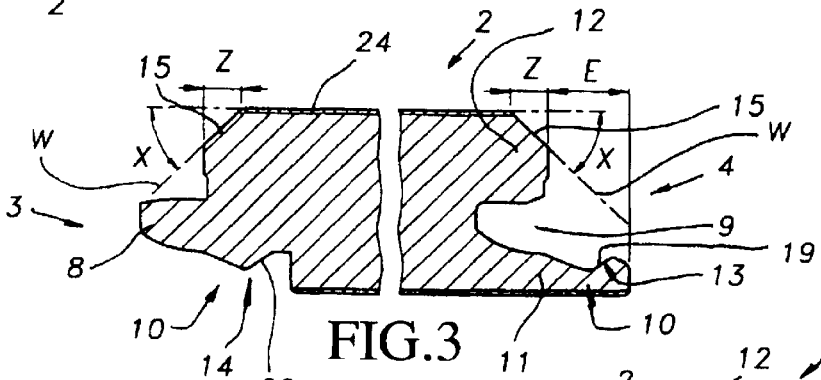
FIGS. 3 and 4 represent sections, according to lines III—III and IV—IV respectively in FIG. 2.
Figure 4:
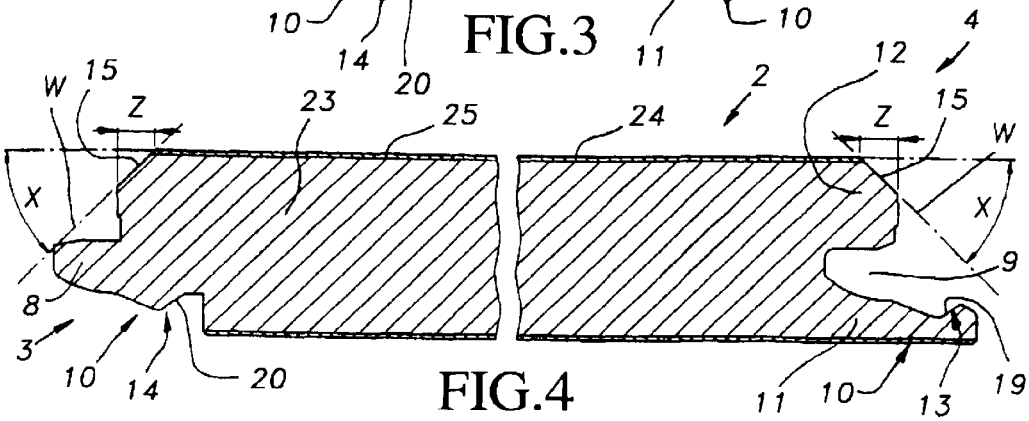

It should be noted that, both as far as the above-mentioned first aspect and the third aspect are concerned, according to a preferred embodiment, one or several, and preferably all bevels 15 extend at such an angle that the plane including the bevel 15, does not intersect the contour of the panel 2 or at most just touches it, as indicated by the lines W in FIGS. 3, 4 and 10 outside the bevel area. This is advantageous in that, both when the bevels 15 are formed and when the print 26 is applied, these bevels 15 are easily accessible to the machine parts used in the manufacturing procedures.

Figure 12:
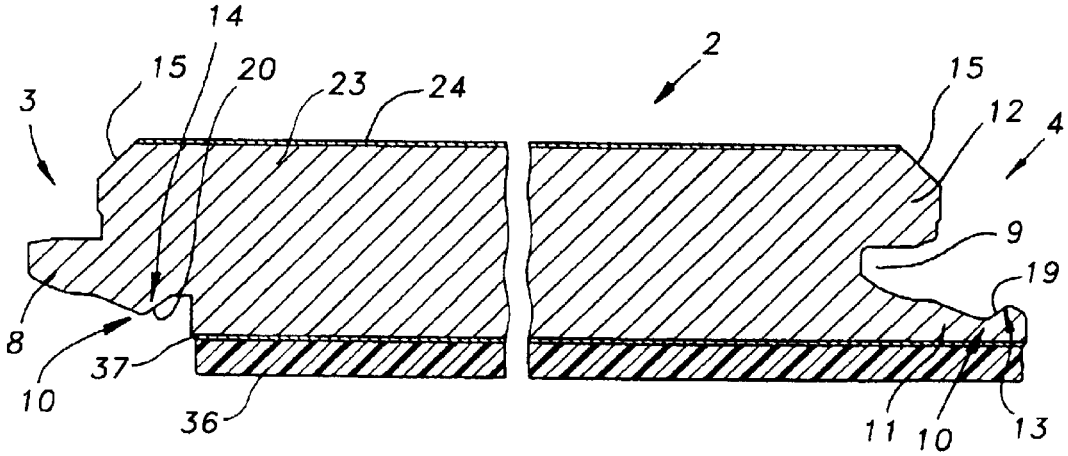
FIG. 12 represents a section of another panel according to the invention.

According to a fourth aspect of the invention, it concerns a floor covering consisting of laminated hard panels 2 with a core 23 based on MDF or HDF, or a similar material, wherein the panels 2 are each separately provided with an underlayer 36 made of synthetic material or another dampening or insulating material provided on the bottom side and fixed onto it, preferably made of polyethylene or polyethylene base material, as represented in FIG. 12. The combination of these materials offers the advantage that little sound is produced when these panels 2 are walked on.

The above-mentioned underlayer 36 can be fixed to the bottom side of the panel 2 in any way whatsoever, for example by means of gluing or by melting it onto the panel. In the case of a conventional laminate construction, the structure thus consists of the decorative layer 25, the core 23, usually based on MDF or HDF, a counterlayer 37, and the above-mentioned underlayer 36.

It is clear that the fourth aspect of the invention can be used in combination with floor panels which are provided with a conventional tongue and groove on their edges, as well as in combination with floor panels with coupling means which provide for a horizontal and a vertical interlocking, for example coupling means 7 as described above.

The invention is by no means limited to the above-described embodiments represented on the accompanying drawings; on the contrary, such a floor and in particular the above-mentioned panels, can be made in all shapes and dimensions while still remaining within the scope of the invention.

What is claimed is:

1. A floor covering panel comprising a top side, at least two opposite edges including coupling elements made in one piece with the panel and arranged so that several ones of such panels can be mutually coupled to form a floor covering, said coupling elements arranged to enable an interlocking of the coupling elements between panels in a direction perpendicular to a plane including the panels, as well as in a direction perpendicular to the respective edges and parallel to the plane including the panels, and wherein said panel is a laminated construction including at least an MDF/HDF core layer and a panel decorative layer above the core layer;

said coupling elements are formed in one piece with the core layer and define tongue and groove interlocking elements;

a cut-away portion adjacent at least one of said two opposite edges, and intersecting said top side, said cut-away portion penetrating and exposing an edge area of said panel decorative layer and said core layer when viewed from the top side of the panel; and a film or coating-like decorative cut-away portion covering layer on the area of the cut-away portion masking said exposed edge area, said decorative cut-away portion covering layer being a separate layer from said panel decorative layer.

2. The floor covering panel according to claim 1, wherein each cut-away portion comprises a bevel extending at an angle of 45° in relation to the plane including the panel.

3. The floor covering panel according to claim 2, wherein each cut-away portion, in the plane of the respective panel, extends over a distance of about 2 millimeter.

4. The floor covering panel according to claim 1, wherein the coupling elements when coupled between ones of said panel, are disconnectable at least in one additional manner other than rotation relative to the coupled edges of the panels.

5. The floor covering panel according to claim 1, wherein the panel is rectangular and said cut-away portion is provided on all four sides of the panels.

6. The floor covering panel according to claim 1, wherein each cut-away portion is a bevel extending at an angle so that the plane including the bevel does not intersect any other portion of the respective edge section of the panel at which the bevel is provided.

7. A floor covering panel according to claim 1, comprising a bottom side, wherein the panel is separately provided with an underlayer attached to the bottom side, said underlayer being polyethylene or polyethylene based material.

8. The floor panel covering according to claim 1, wherein the panel has a minimum thickness of 9 mm.

9. The floor covering panel according to claim 1, wherein the panel has a minimum thickness of 10 mm.

10. The floor covering panel according to claim 1, wherein the coupling elements are configured so that the panels can be rotated in or out of one another at least along said opposite edges.

11. The floor covering panel according to claim 10, wherein said panel is rectangular and elongated, and wherein the width of the panel is smaller than 17 cm.

12. The floor covering panel according to claim 1, wherein said panel is rectangular and elongated and includes said coupling elements on at least two opposite longitudinal edges of the panel, such that several ones of such panel can be mutually coupled to one another along said edges, and wherein the coupling elements are configured such that individual panels can be coupled and/or uncoupled with similar panels by means of rotation motion about cooperating opposed longitudinal edges of the panels, and wherein the width of the panel (2) is smaller than 17 cm.

13. The floor covering panel according to claim 1, including a cut-away portion adjacent at least two opposed edges.

14. The floor covering panel according to claim 1, wherein the decorative cut-away portion covering layer comprises a print.

15. The floor covering panel according to claim 14, wherein said print is a transfer layer.

16. The floor covering panel according to claim 1, wherein the panel decorative layer of the top core surface comprises a paper layer printed with a pattern.

17. The floor covering panel according to claim 1, wherein the decorative cut-way portion covering layer represents a print on each cut-print portion and wherein this provided with a pattern similar to the pattern of the panel decorative layer.

18. The floor covering panel according to claim 1, wherein the decorative cut-way portion covering layer is a moisture-proof impermeable layer.

* * * * *